US005277767A

United States Patent [19]

Cushman et al.

[11] Patent Number: 5,277,767

[45] Date of Patent: Jan. 11, 1994

[54] ELECTROCHEMICAL SYNTHESIS OF DIARYLIODONIUM SALTS

[75] Inventors: Michael R. Cushman; Carl M. Lentz; David D. Cornell, all of Kingsport, Tenn.

[73] Assignee: Eastman Kodak Company, Rochester, N.Y.

[21] Appl. No.: 681,589

[22] Filed: Apr. 8, 1991

[51] Int. Cl.[5] ..... C25B 3/00

[52] U.S. Cl. ..... 204/59 R

[58] Field of Search ..... 204/59

[56] References Cited

U.S. PATENT DOCUMENTS

| | | | |
|---|---|---|---|
| 3,712,920 | 1/1973 | Jezic | 260/332.5 |
| 3,734,928 | 5/1973 | Jezic | 260/332.2 |
| 3,763,187 | 10/1973 | Moyle | 260/332.3 |
| 3,862,333 | 1/1975 | Chalupa et al. | 424/353 |
| 3,885,036 | 5/1975 | Moyle | 424/275 |
| 3,944,498 | 3/1976 | Moyle | 252/106 |
| 3,981,897 | 9/1976 | Crivello | 260/440 |
| 4,087,554 | 5/1978 | Haydock et al. | 424/353 |
| 4,136,102 | 1/1979 | Crivello | 260/440 |
| 4,404,082 | 9/1983 | Cramer et al. | 204/72 |
| 4,513,137 | 4/1985 | Koser et al. | 546/14 |
| 4,623,666 | 11/1986 | Kennedy | 514/754 |
| 4,759,833 | 7/1988 | Lentz et al. | 204/59 R |

FOREIGN PATENT DOCUMENTS

WO85/02174 5/1985 PCT Int'l Appl. .

OTHER PUBLICATIONS

Chemical Abstract CA105(23):209386m (European Patent Application EP 188,351, Jul. 23, 1986).

H. Hoffelner et al., *Journal of Electroanalytical Chemistry*, 66, (1975), pp. 183–194.

L. L. Miller et al., *Journal of the American Chemical Society*, 89 (1967), pp. 593–597.

WPI Acc No. 73-28910U/21 (DE 2 154 348) Derwent abstract.

WPI Acc No. 72-49148T/31 (DE 2 100 381) Derwent abstract.

WPI Acc No. 80-00059C/01 (EP 0 006 177) Derwent abstract.

*Primary Examiner*—John Niebling

*Assistant Examiner*—Patrick J. Igoe

*Attorney, Agent, or Firm*—Betty J. James; William P. Heath, Jr.

[57] ABSTRACT

Electrochemical process for preparing diaryliodonium salts using a single compartment and a carbon anode. The process has high current efficiency and, optionally, increased para, para' regioselectivity. The process proceeds in the presence of a solvent such as acetic acid and an electrolyte such as a compound of fluorine or sulfuric acid.

22 Claims, No Drawings

ELECTROCHEMICAL SYNTHESIS OF DIARYLIODONIUM SALTS

FIELD OF INVENTION

The present invention concerns electrochemical preparation of diaryliodonium salts by use of a carbon anode in a single or undivided electrolytic compartment or cell.

BACKGROUND OF THE INVENTION

The electrochemical formation of diaryliodonium salts is known for benzene plus iodobenzene (see Wendt: H. Hoffelner, H. W. Lorch, H. Wendt, *Journal of Electroanalytical Chemistry*, 66 (1975), pp. 183-194) and toluene plus iodobenzene (see Miller: Larry L. Miller, A. K. Hoffman, JACS, 89 (1967), pp. 593-597) using platinum electrodes, divided cells, acetonitrile solvent and perchlorate electrolyte. In both cases these do not represent commercially feasible sets of conditions. Divided cells are more expensive to operate due to additional voltage drop in the cell. Platinum is too expensive for anode material on a commercial scale. In addition, there is no report of a regioselective system in this prior art which can be important for some applications.

Other prior art of interest includes U.S. Pat. No. 4,759,833 which discloses the simultaneous preparation of a diaryliodonium salt and an alkoxide salt using a divided cell. The only anode taught in this patent is platinum.

Diaryliodonium salts have a variety of uses such as photoinitiators (U.S. Pat. Nos. 4,136,102 and 3,981,897), fungicides (U.S. Pat. Nos. 3,944,498 and 3,763,187) and bactericides (U.S. Pat. Nos. 3,885,036 and 3,712,920). Thus, it would be desirable to have a more economically and industrially feasible process for preparing such compounds.

SUMMARY OF THE INVENTION

The present invention is directed to an electrolytic process for the preparation of a diaryliodonium salt comprising (A) charging an electrolytic cell fitted with a carbon anode and a cathode in a single compartment with a reaction mixture comprising an iodoaryl compound, an aryl compound, a stable electrolyte, and a solvent, and (B) applying an electric potential to the cathode and anode under conditions to promote formation of the desired diaryliodonium salt product.

DETAILED DESCRIPTION OF THE INVENTION

The iodoaryl compound employed as a starting material in the process of the present invention is a heterocyclic or preferably a carbocyclic aromatic compound containing 6 to 11 carbon atoms. It is also possible that the iodoaryl compound can be substituted with groups such as halides, alkyl groups having 1 to 12 carbon atoms, vinyl groups, carboxylic acids or esters, ethers and the like. Preferred iodoaryl compounds include iodotoluene, iodobenzene, iodonaphthalene, iodobenzene substituted with 1 to 5 substituents independently selected from —R, —OR, and $$-\overset{\overset{\displaystyle O}{\|}}{C}-O-R$$

wherein R is an alkyl group of 1 to 12 carbon atoms, and the like.

The aryl compound employed as a starting material in the process of the present invention is heterocyclic or preferably a carbocyclic aromatic compound containing 6 to 11 carbon atoms. The aryl compound of the invention is distinguished from the iodoaryl compound of the invention in that the latter is substituted with iodine and the former compound is not. Preferred aryl compounds include benzene, toluene, naphthalene, or other polycyclic aromatic compounds. It is also possible that the aryl compound can be substituted with groups such as halides (i.e., F, Br, or Cl), alkyl groups having 1 to 12 carbon atoms, vinyl groups, carboxylic acids or esters, ethers, and the like.

In general, the optional substituents on the aryl and iodoaryl compounds can be any group or groups that do not have substantial adverse effects on preparation of the desired diaryliodonium compound.

The method of the invention is conducted using a solvent for the iodoaryl compound, aryl compound and electrolyte. The solvent can be selected from the group consisting of polar solvents, and preferably acyclic polar solvents. Examples of solvents suitable for use with the present invention are alcohols such as methanol, halogenated hydrocarbons such as dichloro methane and chloroform, acetonitrile, organic acids, and the like. The most preferred solvent is acetic acid.

The electrolyte for use in the process of the present invention is one which will conduct an electric current and not have substantial adverse effects on preparation of the desired diaryliodonium compound. Also, the electrolyte can function partially or totally as the reaction solvent. Examples of suitable electrolytes include strong acids such as p-toluene-sulfonic acid and, preferably, sulfuric acid. Other useful electrolytes include organic salts.

The organic salts which can be employed as an electrolyte in the electrolytic process of the present invention are preferably alkali and tetraalkylammonium salts of weak organic acids. However, stronger organic acids may also be utilized. Examples of suitable salts are the sodium, potassium, lithium and ($C_1$-$C_{12}$)tetraalkyl ammonium salts of acetic acid, trihaloacetic acid, p toluenesulfonic acid, IH, BrH, $F_4BH$ and benzenesulfonic acid, among others.

It has been found that use of compounds of fluorine as electrolyte leads to increased regioselectivity for the para, para' isomers (where possible) of the diaryliodonium salt product.

Preferred electrolytes are compounds of fluorine, sulfuric acid or a combination thereof. Examples of compounds of fluorine include NH:HF and HF. It is preferred that HF is used in combination with a minor amount of $H_2SO_4$.

It is important to use an electrolyte that is stable (i.e., unreactive) under the conditions of the electrolytic process. For example, use of electrolytes that have a Cl atom, such as NaCl or $ClSO_3H$, will typically result in unwanted production of $Cl_2$ (easier to oxidize) and little or none of the desired product.

The electrolyte and/or solvent must be capable of contributing a negative ion as the counter ion of the diaryliodonium compound in order to have a salt of said compound. Typical salts include, for example, sulfates, halides such as fluorides, acetates, phosphates, and the like. It may be desirable, after perform an ion exchange for the anion for purposes of, for example, improved solubility or end use efficacy (e.g., enhanced biocide activity). An example of such an ion exchange is exchanging a sulfate ion with an iodide or chloride ion.

The process of the invention is carried out in an undivided or single compartment electrolytic cell equipped with a cathode and anode. Use of an undivided cell is more economical than use of a divided cell.

The nature of the anode for use in the process of the invention is important to achieve increased current efficiency. The anode is comprised of, or preferably consists essentially of, carbon. The form of the carbon anode is not particularly critical. Thus, the anode can be carbon felt, vitreous or glassy carbon, graphitic carbon, or carbon cloth. Graphitic carbon is preferred.

The nature of the cathode for use in the process of the invention has been found not to be particularly critical. Thus, the cathode can be comprised of zinc, platinum, nickel, cadmium, tin, copper, stainless steel, vanadium, carbon, and the like. Preferred is carbon.

The reaction mixture for the process of the present invention preferably contains a minor amount, for example about 1% to about 10%, based on the total weight of the reaction mixture, of a drying agent in order to remove any water present or generated during the process.

Examples of drying agents include, for example, molecular sieves and organic acid anhydrides. When an organic acid is used as the reaction solvent, it is preferred that the drying agent is the anhydride corresponding to the organic acid. Thus, when acetic acid is used as solvent, the preferred drying agent is acetic anhydride.

To perform the process of the invention, the single compartment is charged with the reactants, solvent and electrolyte in any order. An electric potential preferably about 1.75 volts to 2.25 volts, more preferably 1.85 volts to 2.15 volts is then applied to the anode and cathode. Electric potential as referred to herein is vs. SCE. The electric potential is normally applied to the anode and the cathode for a period of time of about 2 hours to 10 hours, and preferably about 5 hours to 7 hours. The reaction can be conducted under quite varied conditions. For example, temperatures of about 25° to about 85° C., and preferably about 27° to about 65° C., and pressures of about 1 atm to 10 atm, and preferably about 1 atm to 5 atm are typical. In general, solution electrical conductivity increases as temperature is raised from room temperature up to the boiling point of at least one of the reactants. In a particularly simple embodiment of the invention, the electric potential is applied to the anode and the cathode as a constant electric potential.

The molar ratio of the iodoaryl compound:aryl compound is preferably about 40:1 to about 1:40, with about 10:1 to about 1:10 being preferred and about 1:1 to about 1:10 being more preferred.

The amount of electrolyte can vary widely since it can optionally be used as all or part of the solvent. For example, about 0.05% to about 99% electrolyte based on the total weight of the reaction mixture can be employed. When the electrolyte is not intended to function as solvent, a preferred amount of electrolyte is about 0.05% to about 5%.

The process of the present invention proceeds with excellent current efficiency. A typical current efficiency is greater than about 50%, preferably greater than about 75%, and more preferably greater than about 95%.

If desired, the process of the present invention can be designed to result in increased regioselectivity for the para, para' (where applicable, i.e., where the iodoaryl moiety and aryl moiety are each monosubstituted) isomers. Such regioselectivity can be important for some applications such as where the diaryliodonium salt is used in a carbonylation process for preparing aromatic carboxylic acids and esters thereof (see U.S. Pat. No. 4,759,833). As previously mentioned, use of a compound of fluorine has been identified as an important factor for achieving increased para, para' regioselectivity. Thus, the mole ratio of the yield of para, para' substituted product:ortho, para substituted product can be greater than about 5:1, in some cases greater than about 10:1 or even greater than about 20:1.

A preferred process of the invention can be described as an electrolytic process for the preparation of a ditolyliodonium fluoride comprising (A) charging an electrolytic cell fitted with a carbon anode and a cathode in a single compartment with a reaction mixture comprising p-iodotoluene, toluene, an electrolyte consisting essentially $NH_3HF$, sulfuric acid, or a mixture thereof, a solvent comprising acetic acid, and a drying agent comprising acetic anhydride, and (B) applying an electric potential to the cathode and anode under conditions to promote formation of the desired diaryliodonium salt product.

In the preferred process it is further preferred wherein said reaction mixture comprises about 0.5 to about 20 weight % p-iodotoluene, about 0.5 to about 20 weight % toluene, about 0.05 to about 5 weight % of the electrolyte, about 50 to about 95 weight % acetic acid, and about 0.01 to about 10 weight % acetic anhydride, and wherein the electrolyte consists essentially of $NH_3HF$ or about 0.05 to about 5 weight % HF plus about 1 to about 10 weight % sulfuric acid.

The products produced by the present invention have at least one of the following uses: photoinitiators, chemical intermediates, pharmaceutical intermediates, thyromimetics, growth hormones, fungicides, bactericides, or viricides.

The invention is further illustrated by the following non limiting examples. All percentages are by weight unless otherwise indicated.

ABBREVIATIONS

Abbreviations used in the following examples have the following meaning:

CE=current efficiency in percent
PP=para, para'
OP=ortho, para
HoAc=acetic acid
$Ac_2O$=acetic anhydride
mm=millimeter
cm=centimeter
tol=tolyl
Et=ethyl
Bu=butyl
V=volt
vs. SCE=versus Saturated Calomel Electrode
A=amps $X^{\ominus}$=negative counter ion such as $HSC_4^{\ominus}$, $F^{\ominus}$, or $OAc^{\ominus}$

EXPERIMENTAL

All work was conducted with an Electrocell MP electrolysis cell. The unit has a 6-mm gap between 100 $cm^2$ parallel planar electrodes. The turbulene promoters and entrance pieces assure full use of the electrode surface. The cell was operated in both batch and continuous modes. Flow was maintained with a variable speed, centrifugal, magnetically coupled, 304 stainless steel pump. A nitrogen blanket was maintained. The power source was capable of generating 0 to 60 volts at 0 to 8 amps. Coulombs were counted on a coulometer. Contact surfaces were glass, stainless steel, polypropylene, and electrode materials. The solvent was acetic acid with the additives as indicated. Analyses for iodonium salts isomeric purity was performed by liquid chromatograph vs. known standards.

Variables considered were:

1. Electrolytes and additives
2. Anode material
3. Current density
4. Temperature
5. Possible reduction of product

EFFECT OF ELECTROLYTES

In Table 1 the effects of supporting electrolyte and additives are shown. The results were very dependent on the selected system. It was found that ditolyliodonium salts could be prepared in high para selectivity with good to excellent current efficiencies in acetic acid solvent with added sulfuric acid in the presence of added fluoride ion at carbon anodes in an undivided cell.

EFFECT OF ANODE MATERIAL

Table 2 compares the results at platinum and carbon anodes vs. the added salt. Both Wendt and Miller indicated the need for platinum anodes. It was found here that a carbon anode is superior to platinum and the anode of choice. Table 3 shows the results of the comparison of a wide range of anode materials. Carbon rods, carbon felt and vitreous carbon all gave good current efficiencies. It is interesting to note that the isomeric ratio is significantly affected by the anode material. Even within the carbon family, the carbon rod gave the most para product, vitreous carbon next and carbon felt the least. The various metallic anodes tested all gave about the same amount of para, para to ortho, para ratios with very poor current efficiencies. The superior role of graphite as an anode is especially remarkable.

EFFECT OF CATHODE MATERIAL

Since the electrolysis is conducted in an undivided cell and since hydrogen evolution is the only desired cathodic reaction, a low hydrogen over potential cathode material is desired. Tables 4 and 5 show the results of various cathodes. Trials with various metals all eventually resulted in the fouling of the cathode. The fouling material was found to be a nonconductive metal iodide salt. The fouling material was difficult to remove and insoluble in acetic acid. The use of graphite cathodes prevented fouling but raised the cell voltage slightly. No evidence was found for the production of free iodine.

EFFECT OF CURRENT DENSITY

Current density is a major factor in the capital cost of electrochemical production. It was found that current densities of 4 to 200 m A/$cm^2$ produced iodonium salts. Above 200 m A/$cm^2$ anode erosion is considered excessive. Lower current density was therefore indicated and could be achieved by the use of expanded surface anodes (VCAR 60 porous graphite or graphite felt). This also resulted in improved regioselectivity.

EFFECT OF TEMPERATURE

Higher temperature is preferred if possible, because of increased solution conductivity. Solution electrical conductivity doubles as the temperature is raised from 27° to 65° C. Above 85° C. toluene begins to boil off.

EFFECT OF REDUCTION OF THE OXIDATION PRODUCT

Cyclic voltammetry experiments were performed to see if iodonium salts reduce at the cathode. If such reduction occurs then it would be unlikely that the electrosynthesis of iodonium salts could be accomplished in an undivided cell. No reduction current was observed.

TABLE 1

Preparation of $Tol_2I^{\oplus}X^{\ominus}$ in Acetic Acid at Carbon Anode, Undivided Cell; Carbon Cathode*

| Supporting Electrolyte | Additives | PP/OP | CE (%) |
|---|---|---|---|
| .25M $Et_4N^+BF_4$ | 1% $H_2SO_4$ | 14.1 | 69 |
| 10% $ClSO_3H$ | — | 6.9 | 0.9 |
| 3% $CF_3SO_3H$ | — | 9.1 | 58 |
| 10% $H_2SO_4$ | 2% $Ac_2O$ | 8.3 | 75 |
| 10% $H_2SO_4$ | — | 8.5 | 39 |
| 2% $H_2SO_4$ | 2 $Ac_2O$ | 7.6 | 69 |
| 5% $H_2SO_4$ | .5M $NH_3HF$ | 23.3 | 97 |
| 5% $H_2SO_4$ | .5M 48% HF | 21.0 | 77 |
| 5% $H_2SO_4$ | .25M $nBu_4N^{\oplus}F^{\ominus}$ | 7.2 | 26 |
| 5% $H_2SO_4$ | 2% $Ac_2O$ | 8.3 | 75 |
| 5% $H_2SO_4$ | 2% $Ac_2O$/SM$NH_3HF$ | 25.0 | 97 |

*All runs used 5.0 mm p-iodotoluene, 10.0 mmol toluene at 2.00 V vs. SCE.

TABLE 2

Preparation of $Tol_2I^{\oplus}X^{\ominus}$ in Acetic Acid/5% $H_2SO_4$/2% $Ac_2O$ in the Presence of Various Salts at Pt or C Carbon Rod Anode with a Carbon Cathode*

| Added Salt | Anode | PP/OP | CE |
|---|---|---|---|
| None | Carbon rod** | 8.3 | 75 |
| .5M $NaHPF_6$ | Carbon rod | 12.2 | 98 |
| .5M $NaH_2PO_4$ | Carbon rod | 3.6 | 37 |
| .5M NaCl | Carbon rod | 0 | 0 |
| None | Platinum** | 3.6 | 3 |
| .5M $NaHPF_6$ | Platinum | 2.9 | 14 |
| .5M $NaH_2PO_4$ | Platinum | 1.1 | 12 |

*All runs were made at 2.00 V vs. SCE in an undivided cell with 0.01 moles of p-iodotoluene.

**Carbon rod having a surface area of 10 $cm^2$; platinum having a surface area of 10 $cm^2$.

TABLE 3

Preparation of $Tol_2I^{\oplus}X^{\ominus}$ in Acetic Acid/5% $H_2SO_4$/2% $Ac_2O$ in the Presence of Various Anodes with Carbon Cathode*

| Anode | PP/OP | CE |
|---|---|---|
| C-rod (10 $cm^2$)** | 8.3 | 75 |
| Carbon felt (30 $cm^2$) | 3.9 | 84 |
| Vitreous carbon (8.6 $cm^2$) | 6.4 | 86 |
| Carbon cloth | 0.0 | 0 |
| Type MA platinized titanium (10 $cm^2$) | 2.9 | 2.0 |
| Pt (10 $cm^2$) | 3.6 | 3.0 |

TABLE 3-continued

| Preparation of $Tol_2I^{\oplus}X^{\ominus}$ in Acetic Acid/5% $H_2SO_4$/2% $Ac_2O$ in the Presence of Various Anodes with Carbon Cathode* | | |
|---|---|---|
| Anode | PP/OP | CE |
| Lead dioxide (28 $cm^2$) | 4.5 | 3.1 |
| Ebonex*** (20 $cm^2$) | 0.0 | 0.0 |
| Pt/Ir (70%-30% on Ti) | 3.3 | 4.3 |

*All runs used 5.0 mm p-iodotoluene, 10.0 mmol toluene at 2.00 V vs. SCE in an undivided cell.
**The number in $cm^2$ following the description of the anode is the surface area.
***Trademark of Ebonex Technologies, Emeryville, CA, U.S.A.

TABLE 4

| Preparation of $Tol_2I^{\oplus}X^{\ominus}$ at Various Cathodes at Carbon Felt Anode* | | |
|---|---|---|
| Cathode | PP/OP | CE |
| Zn (10 $cm^2$)** | 2.0 | 86 |
| Pt (10 $cm^2$) | 2.9 | 39 |
| Ni (10 $cm^2$) | 2.5 | 95 |
| Cd (11 $cm^2$) | 2.3 | 86 |
| Sn (7.9 $cm^2$) | 2.4 | 60 |
| 304 Stainless Steel (7.5 $cm^2$) | 2.0 | 95 |
| Cu (5.0 $cm^2$) | 2.5 | 78 |
| Carbon rod (10 $cm^2$) | 3.9 | 85 |

*All runs used HoAc solvent/5% $H_2SO_4$, 2% $Ac_2O$ with .01 mole iodotoluene in an undivided cell at 2.00 V vs. SCE.
**The number in $cm^2$ following the description of the cathode is the surface area.

TABLE 5

| Preparation of $Tol_2I^{\oplus}X^{\ominus}$ at Various Cathodes at Carbon Rod Anode | | |
|---|---|---|
| Cathode | PP/OP | CE |
| Zn (17 $cm^2$)** | 2.4 | 85 |
| Pt (10 $cm^2$) | 2.5 | 90 |
| Ni (10 $cm^2$) | 2.2 | 95 |
| Ebonex (29 $cm^2$) | 3.2 | 82 |
| Cadmium Foil (12 $cm^2$) | 3.3 | 6.1 |
| Tin Rod | 4.5 | 65 |
| Stainless Steel (75 $cm^2$) | 2.6 | 70 |
| Vanadium Rod | 1.8 | 75 |
| Carbon Rod | 8.3 | 75 |

*All runs used HoAc solvent, 5% $H_2SO_4$, 2% $Ac_2O$ with .01 mole iodotoluene in an undivided cell at 2.00 vs. SCE.
**The number following the description in $cm^2$ is the surface area.

It was felt that the carbon cloth example in Table 3 was probably unsuccessful due to a lack of electrical connection to the carbon cloth. Therefore, the carbon cloth example was rerun and yielded a 78% current efficiency as determined by precipitation as the iodide salt followed by drying, and weighting.

The invention has been described in detail with particular reference to preferred embodiments thereof, but it will be understood that variations and modifications can be effected within the spirit and scope of the invention.

We claim:

1. An electrolytic process for the preparation of a diaryliodonium salt comprising (A) charging an electrolytic cell fitted with a carbon anode and a cathode in a single compartment with a reaction mixture comprising an iodoaryl compound, an aryl compound, a stable electrolyte, and a solvent, and (B) applying an electric potential to the cathode and anode under conditions to promote formation of the diaryliodonium salt product.

2. The process of claim 1 wherein the electrolyte functions partially or totally as the solvent.

3. The process of claim 1 wherein said iodoaryl compound contains 6 to 11 carbon atoms, and said aryl compound contains 6 to 11 carbon atoms.

4. The process of claim 1 wherein said iodoaryl compound is selected from the group consisting of iodotoluene, iodobenzene, iodonaphthalene, and iodobenzene substituted with 1 to 5 substitutents independently selected from —R, —OR, and $$-\overset{O}{\overset{\|}{C}}-O-R$$

wherein R is an alkyl group of 1 to 12 carbon atoms; and said aryl compound is benzene, toluene, or naphthalene.

5. The process of claim 1 wherein the solvent is acetic acid.

6. The process of claim 1 wherein the electrolyte comprises sulfuric acid.

7. The process of claim 5 wherein the electrolyte is a compound of fluorine, sulfuric acid or a combination thereof.

8. The process of claim 7 wherein the reaction mixture further comprises about 1 to about 10% of a drying agent, based on the total weight of the reaction mixture.

9. The process of claim 8 wherein said compound of fluorine is $NH_3HF$ or HF.

10. The process of claim 1 wherein the molar ratio of the iodoaryl compound:aryl compound is about 40:1 to about 1:40; and the amount of electrolyte is about 1% to about 99%, said percentages being based on the total weight of the reaction mixture.

11. The process of claim 1 wherein each aryl group of the diaryliodonium salt product is monosubstituted and the ratio of the yield of para, para substituted product:ortho, para substituted product is greater than about 5.

12. The process of claim 11 wherein said ratio of the yield is greater than about 20 and wherein the current efficiency is greater than about 20.

13. The process of claim 1 wherein the current efficiency is greater than about 75.

14. The process of claim 1 wherein the cathode is comprised of zinc, platinum, nickel, cadmium, tin, stainless steel, copper, vanadium, or carbon.

15. The process of claim 1 wherein the cathode is comprised of carbon.

16. The process of claim 1 wherein the electric potential is about 1.8 to about 2.2 volts.

17. The process of claim 1 wherein the electric potential is applied for a period of time of about 2 to about 10 hours, at a temperature of about 15° C. to about 85° C.

18. The process of claim 1 wherein the carbon anode is a graphitic carbon anode.

19. An electrolytic process for the preparation of a ditolyliodonium fluoride comprising (A) charging an electrolytic cell fitted with a carbon anode and a cathode in a single compartment with a reaction mixture comprising p iodotoluene, toluene, an electrolyte consisting essentially $NH_3HF$, sulfuric acid, or a mixture thereof, a solvent comprising acetic acid, and a drying agent comprising acetic anhydride, and (B) applying an electric potential to the cathode and anode under conditions to promote formation of the desired diaryliodonium salt product.

20. The process of claim 18 wherein said reaction mixture comprise about 0.5 to about 20 weight % p-iodotoluene, about 0.5 to about 20 weight % toluene, about 0.05 to about 5 weight % of the electrolyte, about 50 to about 95 weight % acetic acid, and about 0.01 to about 10 weight % acetic anhydride.

21. The process of claim 19 wherein the electrolyte consists essentially of $NH_3HF$ or about 0.05 to about 5 weight % HF plus about 1 to about 10 weight % sulfuric acid.

22. The process of claim 19 wherein the carbon anode is a graphitic carbon anode.

* * * * *

UNITED STATES PATENT AND TRADEMARK OFFICE

CERTIFICATE OF CORRECTION

PATENT NO. : 5,277,767

DATED : January 11, 1994

INVENTOR(S) : Cushman et al

It is certified that error appears in the above-indentified patent and that said Letters Patent is hereby corrected as shown below:

Column 8, line 58, (claim 19), there should be a "-" between the "p" and the "i" iodotoluene.

Column 8, line 67, line 67, (claim 20), "comprise" should be "comprises".

Signed and Sealed this

Twenty-fourth Day of May, 1994

Bruce Lehman

*Attest:*

BRUCE LEHMAN

*Attesting Officer*

*Commissioner of Patents and Trademarks*